United States Patent [19]

Cordero, Jr.

[11] 4,052,028

[45] Oct. 4, 1977

[54] STRUCTURAL STEELWORKER'S SAFETY CLAMP

[76] Inventor: Jose Cordero, Jr., 1647 Sweetwood Drive, Daly City, Calif. 94105

[21] Appl. No.: 702,644

[22] Filed: July 6, 1976

[51] Int. Cl.[2] ..... E04G 17/18; F21S 1/02; B66D 3/00

[52] U.S. Cl. ..... 248/228; 24/243 R; 24/263 R; 182/3

[58] Field of Search ..... 248/228, 226 B, 316 A; 24/243 G, 263 R, 263 LS, 263 A, 263 B, 243 AD, DIG. 22; 105/141, 142, 147; 182/3, 9; 104/119

[56] References Cited

U.S. PATENT DOCUMENTS

| | | | |
|---|---|---|---|
| 2,182,057 | 12/1939 | Chicoine et al. | 105/141 UX |
| 2,412,598 | 12/1946 | Brush | 105/141 |
| 3,111,912 | 11/1963 | Keiter | 105/141 |
| 3,124,330 | 3/1964 | Robinson | 248/228 |
| 3,137,487 | 6/1964 | Lesser | 182/3 X |
| 3,217,833 | 11/1965 | Smith | 248/228 X |
| 3,348,632 | 10/1967 | Swager | 182/3 X |
| 3,715,991 | 2/1973 | Boyd | 105/141 |

FOREIGN PATENT DOCUMENTS

| | | | |
|---|---|---|---|
| 1,914,952 | 10/1970 | Germany | 182/3 |

*Primary Examiner*—J. Franklin Foss
*Attorney, Agent, or Firm*—Townsend and Townsend

[57] ABSTRACT

A safety clamp to which a workman's lifeline is connected, for removable and slidable attachment to a flanged structural beam. The clamp includes a pair of complementary U-shaped jaw members slidably coupled to a bar member disposed transverse the beam. A quick-release lock mechanism is provided each jaw member to releasably lock it to the bar member. Each jaw member is defined by horizontal upper and lower plate members interconnected by a vertical side member. Rollers or bearings are connected to the upper and side plates to reduce frictional engagement between the clamp and structural beam to which the clamp is connected, thereby allowing the clamp to slide along the beam. In an alternate embodiment the lower plate member is pivotally attached to the vertical side member for rotation. Such pivotal rotation allows the clamp to bypass such obstructions as beam attachment tabs without having to remove the clamp from the beam.

6 Claims, 8 Drawing Figures

STRUCTURAL STEELWORKER'S SAFETY CLAMP

This invention relates to safety devices for structural steelworkers and more particularly to a safety clamp for removable attachment to flanged beam members.

DESCRIPTION OF THE PRIOR ART

Present construction of steel structures, such as buildings, bridges and the like, consists of the assembly at the site of mill-rolled or shop-fabricated steel sections. Many of these steel sections consist of flanged beams which are joined together by riveting, bolting, or welding by the steelworkers. The workmen or steelworkers aare often required to perform their jobs, traversing the horizontal beams of the structure, at great height. Thus, there exists considerable hazard to the workman in the performance of his duties; a hazard which increases with the height of the structure. In addition to taking particular care to avoid missteps, his own possible carelessness, or the carelessness of other workmen, the workmen must also contend with unexpected gusts of wind and other unanticipated occurrences. It can be seen, therefore, that providing a method and apparatus for guarding against the unexpected or possible carelessness of the workman would be highly desirable.

While the preservation of life and limb of the workman is, of course, of primary importance, a device capable of providing safety for the workman and concomitantly permit some freedom of movement can also provide a number of secondary advantages; which advantages include the lowering of occupational insurance rates of workmen (which, in turn, lowers contruction costs) and providing the workman with a device to mitigate his fear of falling. This last-mentioned advantage allows the workman to perform his job with greater confidence, speed, and efficiency.

There are presently a number of safety devices for such use. See, for example, the safety devices disclosed in U.S. Pat. Nos. 2,303,954 and 3,137,487. However, many of the safety devices presently known suffer from one or more deficiencies. For example, some safety devices provide a clamp which is fixedly connected to the upper flange of a structural I-beam during use. A lifeline is attached to the clamp while the other end is attached to a safety harness or belt worn by the workman. Freedom of movement of the workman is seriously hampered by a short lifetime. To move from one job position to another, the workman must disconnect the clamp, move to the other job position (without the safety provided by the device) and reconnect the clamp to the beam. Alternatively, lengthening the lifeline to expand the workman's freedom of movement can increase the hazard of injury. For example, in the event of fall, the joint received by the workman when he reaches the end of the lifeline could be quite substantial. Additionally, after such a fall, the workman could also be injured by swinging into the vertical frame members while hanging at the end of the longer lifeline.

Other presently available safety devices are not adjustable. Attachment of these clamps to I-beams, for example, does not take into account the fact that I-beam flanges are available in width. Thus, such clamps are usable only with I-beams having flanges of specific widths and are, therefore, unsuitable or unusable for attachment on I-beams having flange widths other than anticipated.

Further, some known safety devices are not movable along the beam without a large amount of effort, so that movements of the workman are again hampered. Moreover, some structural members, such as I-beams, have short vertical-oriented tabs horizontally extending from and perpendicular to the vertical web of the beam. The tab extends between the top and bottom flanges. A workman connected to present movable safety clamps is requied to diconnect the clamp from the beam and reconnect to the beam to bypass such vertical tabs when encountered.

Thus, a need has arisen for a safety clamp which can be quickly and easily attached to or removed from a flanged structural member — such as an I-beam; the safety clamp should be easily movable along the beam to which it is attached. There is also a need for clamps, possessing qualities just recited, that can move along a beam and bypass the vertical tabs described above without having to detach the clamp from the beam.

SUMMARY OF THE INVENTION

Accordingly, the present invention satisfies the aforementioned needs by providing a safety clamp, to which a workman may attach a lifeline or the like, which may be connected to a flange of a structural beam that readily and speedily adjusts to the width of the beam; a safety clamp that is constructed so that it may slide easily along the beam when pulled or pushed by the workman and in an alternate embodiment, can bypass the vertical tabs without having to detach or disconnect the clamp from the beam.

Thus, the present invention provides a safety clamp for attachment to a flange of a beam that includes an elongate bar member disposed above and transverse the beam flange, complementary U-shaped jaw members slidably coupled to the bar member and adapted to receive the beam flange, and a quick release lock mechanism attached to each jaw member that releasably locks each jaw member to the bar. Each U-shaped jaw member is defined by horizontal top and bottom plates that are interconnected by a vertical side member. Roller or bearings are attached to front and back edge portions of the top plate and vertical side member of each jaw member to provide rolling engagement between the clamp and the beam flange. Also connected to the bar is an eyelet connector to which one end of a workman's lifeline may be attached, the other end of the lifeline being attached to a workman's safety belt or harness.

The roller bearings substantially decrease frictional engagement between the clamp and beam to allow the workman to traverse the beam in any longitudinal direction. The workman may pull the clamp by the lifeline or, alternately, push the clamp along the beam with his foot. Moreove, the quick-release locking mechanism allows the clamp to be quickly and easily removed and attached to beam flanges of variable width.

In an alternate embodiment, the bottom plate of one or both jaw members includes three co-planar sections arranged and interconnected in generally cloverleaf configuration. The bottom plate is coupled to the vertical side member so that the cloverleaf configuration of the bottom plate rotates generally about the centrally located interconnection point of the three co-planar sections. One of the three sections always underlies the upper flange of the beam to which the clamp is connected. Vertical tabs that are encountered, when the workman moves the clamp along the beam, are bypassed when the tab engages the section of the lower plate and rotates the lower plate to move the section presently underlying the flange out from its undering position. Concomitantly, this rotation moves an adjacent section of the cloverleaf configuration into the underlying position with the I-beam flange.

For a fuller understanding of the nature and advantages of the invention, reference should be had to the ensuing detailed description taken in conjunction with the accompanying drawings.

DETAILED DESCRIPTION OF THE PREFERRED EMBODIMENT

Figure 1:
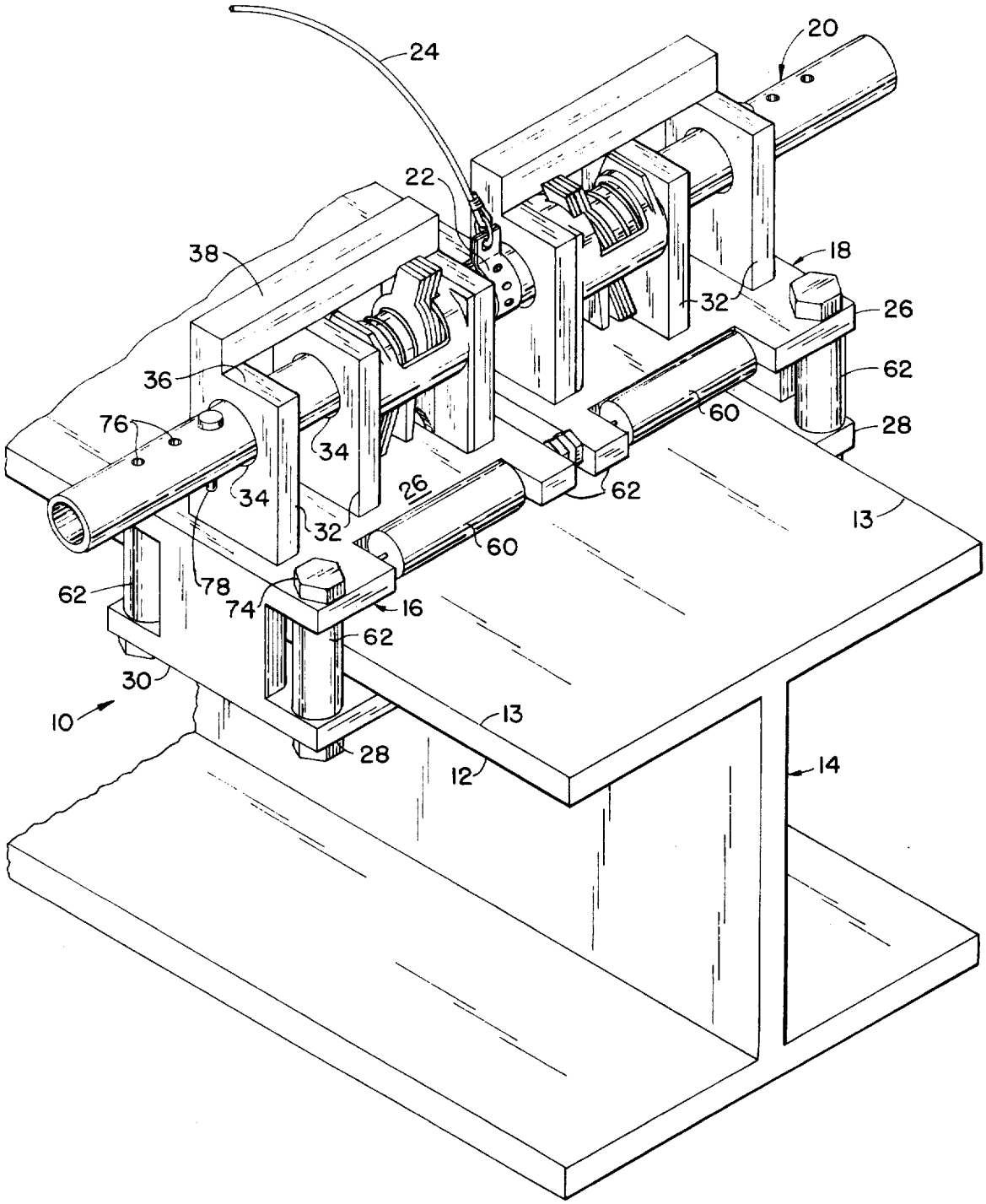
FIG. 1 illustrates by perspective view the safety clamp attached to an I-beam.
Figure 2:
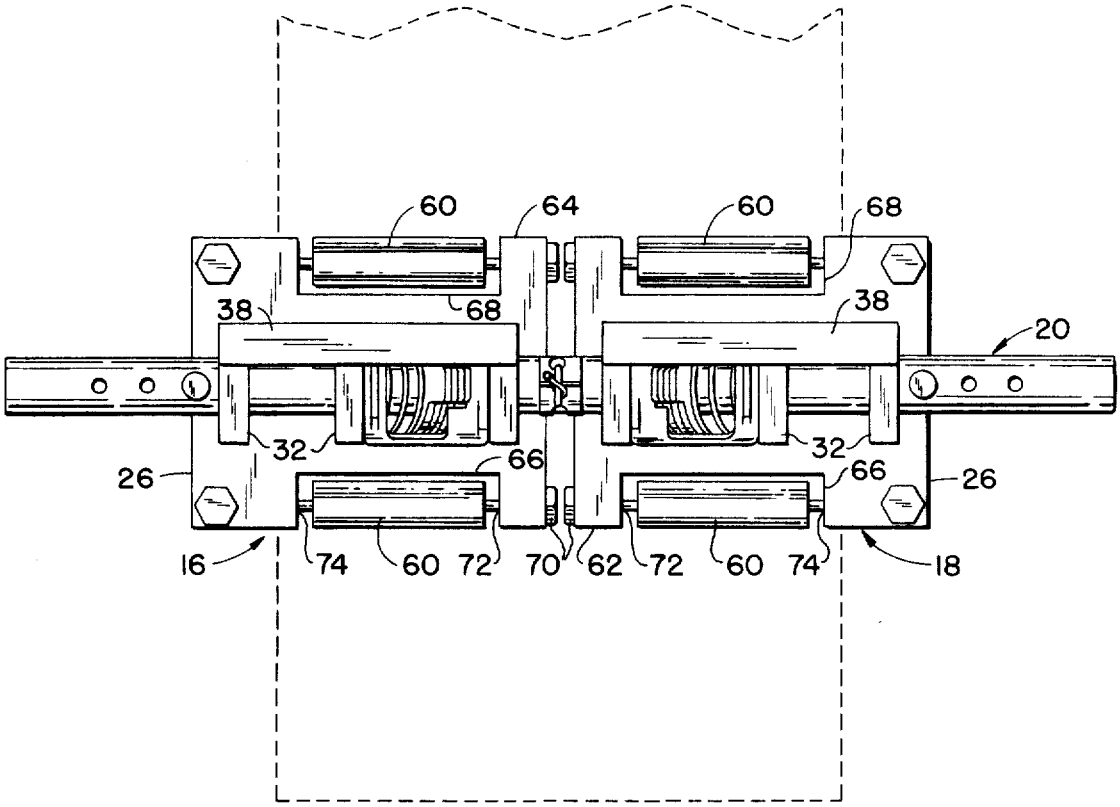
FIG. 2 is a top view of the invention.
Figure 3:
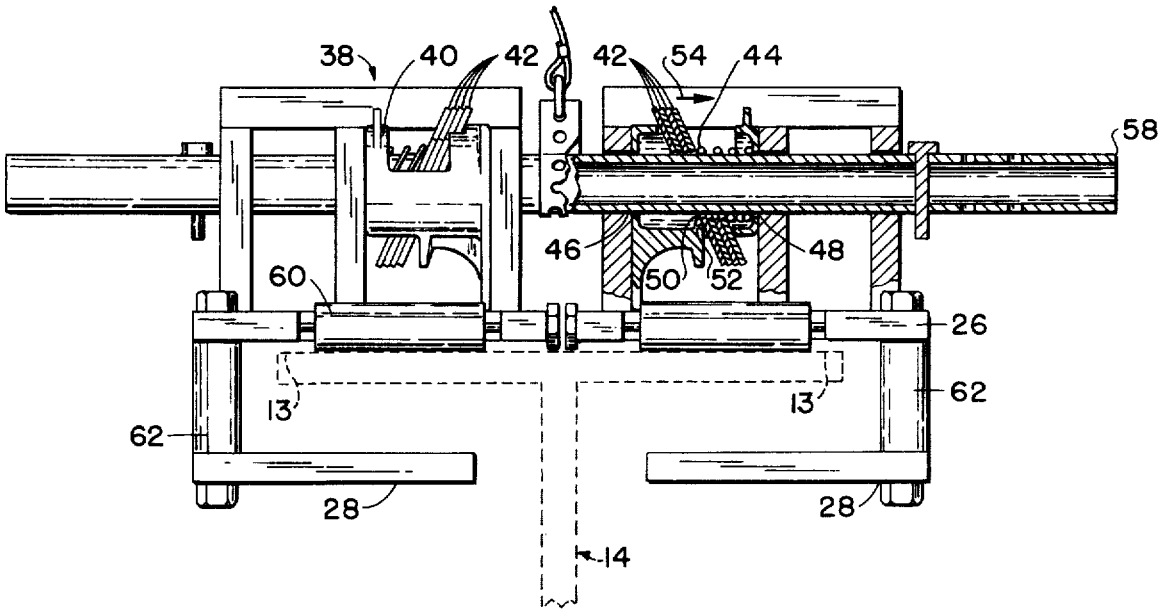
FIG. 3 is a front view of the present invention with a portion of one jaw member cut away.

Turning now to the drawings, FIGS. 1–3 illustrate the preferred embodiment of the invention. As seen in these figures, a safety clamp, generally designated by reference numeral 10, is shown attached to the upper flange 12 of I-beam 14 and includes a complementary pair of generally U-shaped jaw members 16 and 18 slidably mounted on an elongate bar member 20. Situated between jaw members 16 and 18 on bar member 20 is connector 22 to which a flexible steel cable or lifeline 24 may be attached. The other end of lifeline 24 may be attached to a workman's safety harness or belt (not shown) by any conventional means.

Complementary jaw members 16 and 18 are identical in construction and, therefore, a description of jaw member 16 is applied equally to jaw member 18 with like numerals referring to like elements. The general U-shape of jaw member 16 is defined by upper and lower plates 26 and 28, respectively, which are interconnected by side member 30. Fixedly attached to top plate 26, and extending upward therefrom, are flanges 32 with apertures 34 therethrough. Apertures 34 of each flange 32 are positioned so as to be in axial alignment with each other as well as the apertures 34 of flanges 32 of jaw member 18. The diameter of each aperture 34 is sufficient to allow bar member 20 to be loosely received therein. Secured to top portions 36 of each flange 32 is structural bar 38 to improve the structural rigidity of the flanges.

Situated in the interstitial area between the two rightmost upright flanges 32 of jaw member 16 is a quick-release lock mechanism 38 for releasably locking each jaw member 16, 18 to the bar element 20. Lock mechanism 38 includes housing 40, lock plates 42 and bias spring 44 (FIG. 3). Housing 40 has front and back apertures 46 and 48, respectively, while lock plates 42 have apertures 50 therethrough. Apertures 46, 48 of housing 40, as well as aperatures 50 of lock plates 42, 48 of housing 40, as well as apertures 50 of lock plates 42, are in axial alignment with apertures 34 of flanges 32 and sufficiently sized to accept bar member 20 therethrough. As FIG. 3 illustrates, the top portion of plates 42 are biased towards aperture 46 by spring 44. The lower portion of plates 44 are held stationary at heel 52 of housing 40. With lock plates 42 biased as described, lock mechanism 38 substantially resists any movement of bar member 20 towards end 54 of the bar member (FIG. 3).

When the lock mechanism of jaw member 16, 18 are positioned on bar 20 as shown in FIG. 3, the frictional hold established by lock plates 42 of lock mechanism 38 on the bar may be released by moving the top portions of lock plates 42 in the direction of arrow 54, thereby allowing slidable adjustment of jaw member 18 along, or removal from, bar member 20. However, the construction of lock mechanism 38 allows bar member 20 to be inserted through aperture 46 of housing 40, apertures 50 of lock plates 42, and then through aperture 48 of the housing without having to release the mechanism as described.

In order to facilitate longitudinal movement of clamp 10 along I-beam 14, jaw members 16 and 18 are provided with top and side rollers 60 and 62, respectively. To accommodate attachment of top rollers 60, front and rear edges 62 and 64 of each jaw member have rectangular cut-out portions 66 and 68, respectively, to receive the rollers. Top rollers 60 are journalled on bolts 70 which, in turn, are positioned to run parallel to the larger dimension of the cut-outs 66. Bolts 70 are inserted through an appropriately sized aperture 72 of top plates 26 and threaded into aperture 74 of each top plate. Top rollers 60 may be of any commercial construction so long as the diameter of the rollers are somewhat greater than the thickness of plate 26 to allow the rollers to engage flange 12 of I-beam 14. When so constructed, the clamp may be moved along I-beam 14 in a longitudinal direction quite easily.

Movement of the clamp 10 along a structural member is further facilitated by side rollers 62 which are positioned parallel vertical side member 30 and are of sufficient diameter with respect to the thickness of side members so as to hold the side plate away from edges 13, 13 of top flange 12 of the I-beam. Side bearings 62 are journalled on bolts 74 which are perpendicular to and extend between top plate 26 and bottom plate 28.

In addition to the lock mechanisms 38 of each jaw member 16, 18 to inhibit movement of the jaw members away from the flange, there is provided along bar member 20 apertures 76 for receiving safety pin 78. Thus, when the clamp 10 has been appropriately connected to the upper flange 12 of I-beam 14, safety pin 78 may be inserted in the aperture 76 of bar member 20 nearest jaw member 16 (and 18).

When connected to an I-beam 14, as shown in the figures, a worker may attach the lifeline 24, one end of which is affixed to connector 22, to a safety belt or a harness which the steelworker wears (not shown). Thus, when working along the I-beam at substantial heights, the worker is assured, in the event of a fall caused by a momentary lapse in concentration, gusts of wind, or the like, the worker is assured that the fall will be limited to the length of cable 24. Additionally, the worker has a substantial amount of freedom to move along the particular I-beam to which clamp 10 is connected merely by pushing or pulling the clamp in the desired direction; rollers 60, 62 act to facilitate movement of the clamp along the beam.

The construction of the clamp allows it to be removed from a beam quickly and easily. For example, jaw member 18 is disconnected by first removing safety pin 78 from bar member 20. Lock plates 42 are then disposed in the direction of arrow 54 (FIG. 3) to release their frictional hold on bar 20. Jaw member 18 is then slid towards end 58 of bar 20. The clamp 10 may then be removed from I-beam 14 and attached to another I-beam by merely reversing the steps previously recited.

Figure 4:
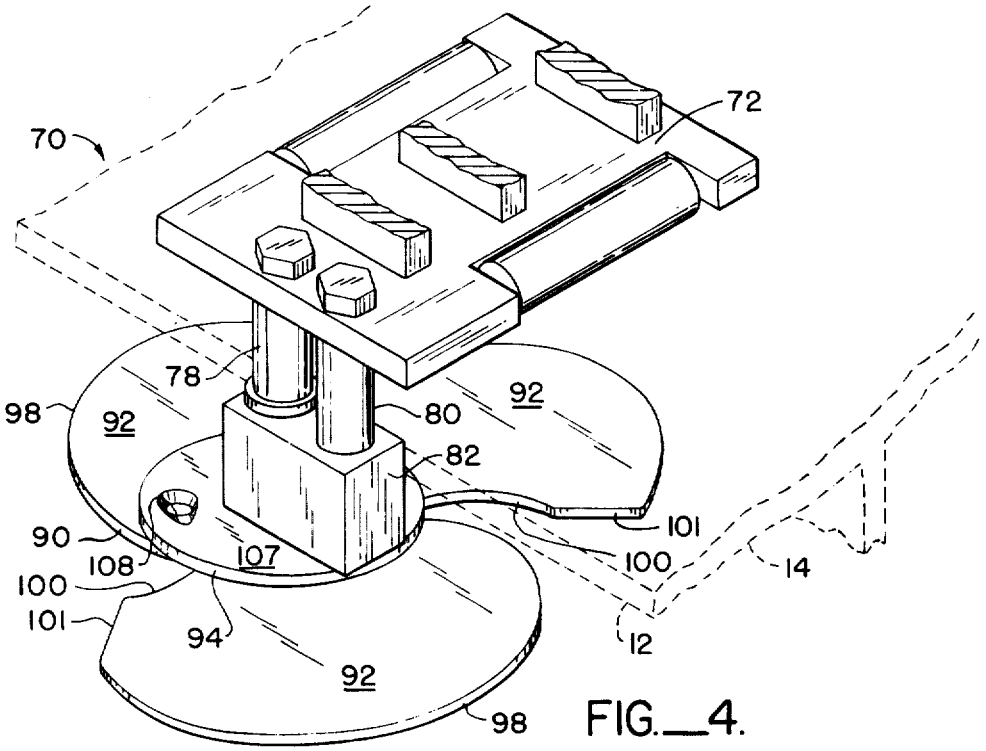
FIG. 4 illustrates by perspective view an alternate embodiment of the safety clamp of the present invention having a rotatably-attached lower plate.
Figure 5:
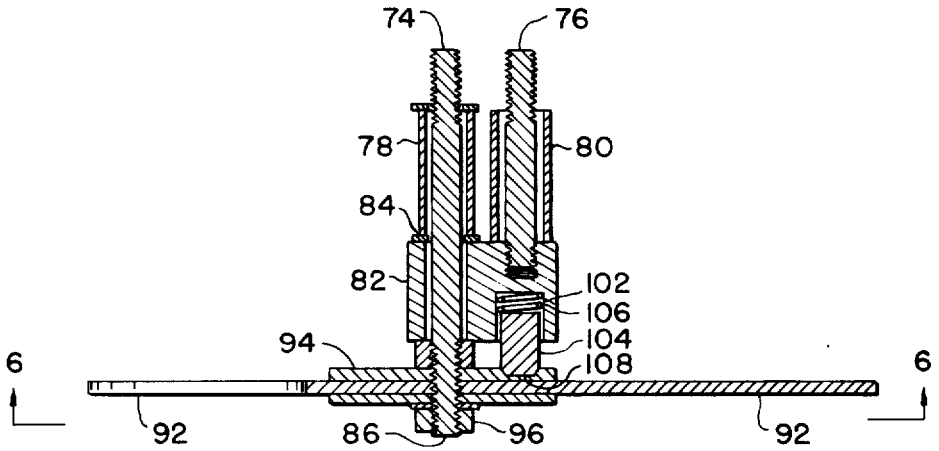
FIG. 5 is a fragmentary cross-sectional view of the safety clamp of the present invention showing the rotational attachment of the lower plate to the vertical side member.

Turning now to FIGS. 4–6, an alternate embodiment of the present invention may now be described. This embodiment allows the safety clamp to bypass a vertical tab of structural beam. Shown in the figures is jaw member 70 having an upper plate 72 essentially identical in construction to upper plates 26 or 28 of jaw members 16 and 18, respectively. The vertical side member 30 of the preferred embodiment now includes bolts 74 and 76 with rollers 78 and 80, respectively, journalled thereon. Bolt 76 is threadedly connected to connector block 82 while bolt 74 extends through and beyond the connector block. Attached to the end 86 of bolt 74 is lower plate 90 comprising leaf sections 92, which are arranged in a generally co-planar cloverleaf configuration and centrally interconnected by plate 94. Each leaf section 92 is defined by an arcuate leading end 98 and a trailing arcuate edge 100 joined by a generally linear edge 101.

Lower plate 90 is connected to bolt 74 by threading the plate onto the bolt followed by nut 96, although any other commercially available means of attachment may be used, such as a welding or the like.

Connector block 82 is provided a recess 102 which slidably contains a detent finger 104 and bias spring 106. Located on the upper surface 107 of connector plate 94 are detent depressions 108 adapted to receive detent finger 104 and thereby provide a detent mechanism that locks or unlocks rotational movement of the lower plate 90. This detent mechanism acts to hold one of the leaf sections 92 in a position underlying flange 12 of beam 14.

Figure 6A:
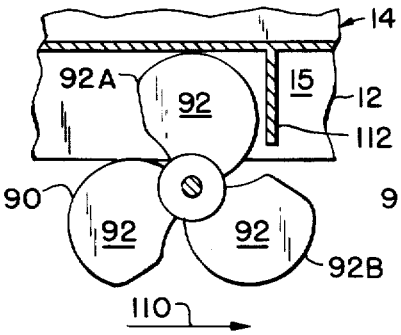
FIGS. 6A–6C are bottom views of the lower plate along lines 6—6 of FIG. 5, showing the sequence involved by bypass a vertical tab of a structural beam.
Figure 6B:
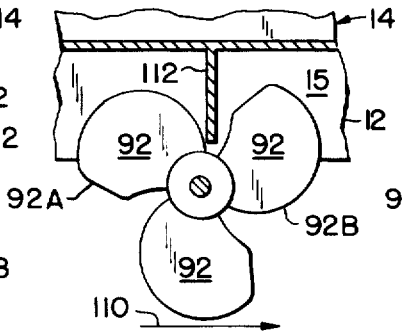
Figure 6C:
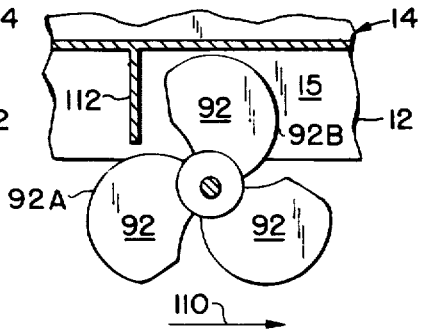

Referring now to FIGS. 6A–6C, operation of the lower plate 90 to bypass a vertical tab may now be described. The figures illustrate operation of the lower plate viewed from below the plate and I-beam 14.

Assume that the workman, whose lifeline is attached to the clamp, is walking along the beam 14, pulling or pushing the clamp in the direction of arrow 110. As FIG. 6A shows, this movement of the device 10 will cause the leaf section 92A underlying upper flange 12 to come into contact with vertical tab 112.

Continued movement of the device 10 in the direction of arrow 110 with sufficient force will cause the detent depression 108 to move detent finger 104 against the bias of spring 106 causing the detent finger to move into recess 102 of connector block 82 (FIG. 5). This allows lower plate 90 to begin rotation about bolt 94 (FIG. 6B). Such rotation causes the leaf section 92A of lower plate 90, which underlies flange 12 prior to engagement with the tab 112 (FIG. 6A), to be rotated in a counterclockwise direction out from under the flange; the upstream leaf section 92B is also caused to similarly rotate into an underlying position with the flange (FIGS. 6B and 6C).

It is advantageous at this point to particularly note, as illustrated in FIG. 6B, that the particular cloverleaf design of lower plate 90 insures that, during such rotation, a portion of the plate always underlies flange 12. Thus, the safety device of the present invention can be moved along I-beam 14 in a longitudinal direction, bypassing vertical tab 12 while maintaining a secure clamping relation with the beam.

The arcuate leading edge 98 of leaf section 92 is of sufficient radial dimension so that the encounter between the edge and tab 112 will cause approximately a full 120° rotation of the plate 90 in bypassing the tab. This will cause sufficient rotation of the plate so that the next upstream detent depression 108 will be placed approximately beneath detent finge 104. The detent will then be received by the detent depression to again hold plate 90 in the position shown in FIG. 6C.

It should be noted that the arcuate curve defining each trailing edge 100 of each leaf section must have sufficient curvature and be spaced from the adjacent and opposing leading edge 98 to allow tab 112 to become inserted between these two edges during the bypass operation (see FIG. 6B). As can be seen, the linear edge 101 separating the leading and trailing edge provides clearance for leaf section 92B as it is rotated under flange 12 and towards tab 112. That is, if the leading and trailing edges were to continue in their arc to a point of intersection, rotation of the lower plate could be inhibited when this point of intersection came into contact with tab 112. Thus, linear edge deletes this point of intersection to provide the clearance needed between the edges of leaf section 92B and tab 112 to allow full rotation of lower plate 90.

As will now be apparent, safety clamps fabricated in accordance with the teachings of the present invention are relatively inexpensive to manufacture, simple to use and manipulate. The clamp 10 may be utilized with I-beams having a variety of widths of the upper flanges. The alternate embodiment of clamp 10 allows its use with I-beams having vertical attachment tabs extending out from and perpendicular to the vertical webbing between the two flanges of the beam. Moreover, as has been pointed out, the rollers 60, 62 provide the steelworker with substantially more freedom of movement than has heretofore been attained with safety devices presently known.

While the above provides a full and complete disclosure of the preferred embodiment of the invention, various modifications, alternate constructions and equivalents may be employed without departing from the true spirit and scope of the invention. For example, lower plates 28 (or lower plate or plates, as the case may be, 90 of the alternate embodiment) of each jaw member can be made adjustable so that, if necessary, flange thickness of the beam may be accommodated. Therefore, the above description and illustration should not be construed as limiting the scope of the invention, which is defined by the appended claims.

I claim:

1. A safety clamp adapted to be slidably attached to an I-beam for providing a connection to which one end of a workman's lifeline may be attached, said clamp comprising:

an elongate bar member adapted to extend transverse said I-beam;

a pair of jaw members slidably coupled to said bar member, each of said jaw members including opposed inner portions having U-shaped indentations adapted to receive a flange of said beam, at least one of said jaw members having a plate member that defines a leg of said U-shaped indentation of said one jaw member, said plate member being rotatably attached to said one jaw member for rotation in a plane parallel to and underlying said flange;

bearing means connected to each of said jaw members and disposed to engage a top surface of said I-beam flange; and locking means coupled to each of said jaw members for releasably securing each of said jaw members of said bar member to prevent movement of said jaw members away from one another.

2. The safety clamp of claim 1, wherein each said jaw member includes an upper plate member having a front and rear edge extending transverse said I-beam when said clamp is attached thereto, and a substantially cylindrical roller coupled to each of said front edge and rear edge of said plate.

3. The safety clamp of claim 1, wherein each of said jaw members includes a vertical side member having second bearing means coupled thereto for providing rollable engagement with said flange.

4. A safety clamp for attachment to a flange of a structural member, said clamp comprising:

a pair of jaw members having opposed U-shaped inner portions adapted to receive said flange, said inner portion of each said jaw member defined by generally parallel upper and lower plate members interconnected by a vertical side member, said lower plate member of at least one of said jaw members including a plurality of co-planar plate elements, at least one of said plate elements underlying said flange when said clamp is attached thereto;

means for rotatably attaching said lower plate member of said one jaw member to said vertical side member; and means for connecting said jaw members in opposing relation and for holding said jaw members in engagement with said flange.

5. The safety clamp of clamp 1, including bearing means attached to aid upper plate member of each of said jaw member for providing slidable engagement with said flange.

6. The safety clamp of claim 1, wherein said lower plate member is defined by three plate elements arranged in a generally cloverleaf fashion.

* * * * *

UNITED STATES PATENT AND TRADEMARK OFFICE

CERTIFICATE OF CORRECTION

PATENT NO. : 4,052,028

DATED : October 4, 1977

INVENTOR(S) : Jose Cordero, Jr.

It is certified that error appears in the above-identified patent and that said Letters Patent are hereby corrected as shown below:

Claim 1, line 20 (column 7, line 5) after "members", delete "of" and insert therefor --to--.

Claim 5, line 1, after "of", delete "clamp 1", and insert therefor --claim 1--; line 2, after "to", delete "aid" and insert therefor --said--.

Claim 6, line 1, after "claim", delete "1" and insert therefor --4--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*